US011618034B2

(12) United States Patent
Mark et al.

(10) Patent No.: US 11,618,034 B2
(45) Date of Patent: Apr. 4, 2023

(54) ROLLER MILL WITH A SCRAPER

(71) Applicant: BÜHLER AG, Uzwil (CH)

(72) Inventors: Daniel Mark, Wil (CH); Daniel Rickenbach, Wittenwil (CH); Philippe Holenstein, Henau (CH)

(73) Assignee: Bühler AG, Uzwil (CH)

( * ) Notice: Subject to any disclaimer, the term of this patent is extended or adjusted under 35 U.S.C. 154(b) by 0 days.

(21) Appl. No.: 17/058,423

(22) PCT Filed: May 27, 2019

(86) PCT No.: PCT/EP2019/063624
§ 371 (c)(1),
(2) Date: Nov. 24, 2020

(87) PCT Pub. No.: WO2019/224395
PCT Pub. Date: Nov. 28, 2019

(65) Prior Publication Data

US 2021/0213456 A1 Jul. 15, 2021

(30) Foreign Application Priority Data

May 25, 2018 (EP) ..... 18174238

(51) Int. Cl.
*B02C 4/40* (2006.01)
*B02C 4/02* (2006.01)

(52) U.S. Cl.
CPC . *B02C 4/40* (2013.01); *B02C 4/02* (2013.01)

(58) Field of Classification Search
CPC ..... B02C 4/40; B02C 4/02
(Continued)

(56) References Cited

U.S. PATENT DOCUMENTS 209,829 A 11/1878 Nemelka
328,413 A 10/1885 Krutzsch
(Continued)

FOREIGN PATENT DOCUMENTS

BE 527109 3/1954
CN 201740389 2/2011
(Continued)

OTHER PUBLICATIONS

English translate (JPH08309213A), retrieved date May 10, 2021.*
(Continued)

*Primary Examiner* — Matthew Katcoff
*Assistant Examiner* — Mohammed S. Alawadi
(74) *Attorney, Agent, or Firm* — Finch & Maloney PLLC

(57) ABSTRACT

A roller mill (1) including a housing (2) having a milling-material inlet (3), at least one milling-material outlet (4), and at least two cambered rollers (5, 5') which are each arranged in the housing (2) so as to be rotatable about a roller axis (6). At least one roller (5) is assigned a scraper (7). The scraper (7) has a blade (8) for scraping milling material from a roller surface (9) with a scraper edge (10) which extends over an entire length (L) of the blade (8), and comprises a holder (11) with a receiving region (12). The holder is arranged in the housing (2) so as to be tiltable about an axis (13) parallel to the roller axis. An elastic bearing (14) is arranged between the blade (8) and the receiving region (12).

15 Claims, 3 Drawing Sheets

(58) Field of Classification Search
USPC ..... 241/166
See application file for complete search history.

(56) References Cited

U.S. PATENT DOCUMENTS

| | | | | |
|---|---|---|---|---|
| 373,408 | A | 11/1887 | Mawhood | |
| 429,381 | A | 6/1890 | Harvey | |
| 801,259 | A | 10/1905 | Neumann | |
| 2,124,008 | A | 7/1938 | Roth | |
| 2,125,859 | A | 8/1938 | Liebelt | |
| 2,915,421 | A | 12/1959 | Miller | |
| 2,929,091 | A | 3/1960 | Freytag | |
| 2,969,193 | A | 1/1961 | Ball et al. | |
| 2,991,019 | A | 7/1961 | Sugden | |
| 3,130,976 | A * | 4/1964 | Niswander | F16C 33/22 277/585 |
| 3,567,187 | A | 3/1971 | Antalek et al. | |
| 3,778,861 | A | 12/1973 | Goodnow | |
| 4,367,120 | A * | 1/1983 | Hendrikz | D21G 3/005 15/256.51 |
| 4,434,522 | A * | 3/1984 | Linzberger | B02C 4/40 101/157 |
| 4,906,335 | A | 3/1990 | Goodnow et al. | |
| 5,400,710 | A | 3/1995 | Ehrhard | |
| 6,447,646 | B1 * | 9/2002 | Hassinen | D21G 3/005 101/169 |
| 6,786,999 | B2 * | 9/2004 | Goodnow | D21G 3/005 15/256.51 |

FOREIGN PATENT DOCUMENTS

| | | | | |
|---|---|---|---|---|
| CN | 102862245 | A * | 1/2013 | B29B 7/64 |
| CN | 202860620 | | 4/2013 | |
| DE | 38 06 651 | A1 | 9/1989 | |
| DE | 299 13 598 | U1 | 11/1999 | |
| EP | 0 040 432 | A1 | 11/1981 | |
| EP | 0 653 276 | A1 | 5/1995 | |
| EP | 0 694 374 | A2 | 1/1996 | |
| GB | 964357 | | 7/1964 | |
| JP | 57-500501 | | 3/1982 | |
| JP | S61-74653 | | 4/1989 | |
| JP | H08-309123 | A | 11/1996 | |
| JP | H08309213 | A * | 11/1996 | |
| JP | 2003-323046 | | 11/2003 | |
| WO | 2005063487 | A1 | 7/2005 | |

OTHER PUBLICATIONS

English translate (CN102862245A), retrieved date May 10, 2021.*
European Search Report Corresponding to EP 18174238 dated Nov. 26, 2018.
International Search Report Corresponding to PCT/EP2019/063624 dated Jun. 27, 2019.
Written Opinion Corresponding to PCT/EP2019/063624 dated Jun. 27, 2019.
Japanese Office Action corresponding to JP 2020-565877 dated May 19, 2021.
Chinese Office Action corresponding to CN 2021042902645630 dated May 7, 2021.
Korean Office Action Corresponding to 10-2020-7036746 dated Mar. 10, 2021.

* cited by examiner

ROLLER MILL WITH A SCRAPER

The invention relates to a roller mill with a scraper as claimed in the independent claim.

Cambered rollers are used in roller mills to counteract bending of the roller in operation that is caused by the high contact pressure forces prevailing during the milling of milling material. It is thus ensured that, during operation, the milling gap has a uniform milling gap width. Directly downstream of the milling gap there is arranged a scraper which is used for scraping milling material.

The scraper is intended to ensure that milling material does not remain adhering on the roller, since such adherence of milling material is undesired in many respects. On the one hand, milling material which remains adhering on the roller causes a narrowing of the milling gap upon renewed passage therethrough that can lead to undesired oscillations and vibrations. On the other hand, upon renewed passage through the milling gap, the adhering milling material is still further compressed and compacted, with the result that the removal of milling material adhering on the roller by means of a scraper is made more difficult. This is unfavorably influenced by the high temperatures which prevail during milling and which cause drying and "caking" of milling material. Moreover, adhering milling material offers a better adhesive surface for further milling material and promotes the growth of such milling-material accumulations. In the worst case, the roller has to be stopped and manually freed from encrustations in a laborious manner.

Use has been made up until now of scrapers which have a blade with a scraper edge which is straight in the inoperative state, or in the nondeformed state, and which is fixedly clamped in a holder. The holder is pivotably arranged below the roller, directly downstream of the roller gap, and is pressed during operation against the roller by means of a counterweight which is fastened to an extension arm of the holder.

The blade is oriented on the stationary roller, and the holder is then bent in the center, which corresponds to the center of the roller, by means of a traction device (which often simultaneously serves as an extension arm for the counterweight) in order to compensate for the camber of the roller. Such a scraper is shown in EP 0 040 432 A1.

Since such a compensation takes place with the roller stationary, but the roller is bent during operation and the camber correspondingly changes, such a solution is not satisfactory. Although an originally straight blade can be worn in to accommodate a roller camber, there nevertheless remain other causes for noncontact between the scraper and the roller. For example, on account of deformation and thermal expansion during operation, a camber does not remain constant. In the prior art, use is made of a relatively high contact pressure force of the scraper (in order to deform it such that it is sufficiently well adapted to the roller surface) than would be actually required for effective cleaning. This relatively high contact pressure force results in unnecessarily high wear of the scraper and of the roller surface.

It is therefore an object of the present invention to provide a roller mill having at least one scraper which avoids the disadvantages of the known one and in particular allows optimal adaptation to the camber of a roller during operation while observing the safety regulations and is low-wear.

The object is achieved by a roller mill as claimed in independent claim 1.

The roller mill comprises a housing having a milling-material inlet, at least one milling-material outlet and at least two cambered rollers which are each arranged in the housing so as to be rotatable about a roller axis.

At least one roller is assigned a scraper. A plurality of rollers, preferably all the rollers of the roller mill, are preferably equipped with a scraper. It is also possible for a roller to be assigned a plurality of scrapers.

According to the invention, the scraper comprises a blade for scraping milling material from a roller surface. The blade has a scraper edge which extends over the entire length of the blade. The length of the blade preferably substantially corresponds to the axial length of the roller such that a blade can be used to scrape the entire roller surface. Also conceivable is a segmented blade consisting of a plurality of elements which, when lined up, can scrape the entire roller surface.

The scraper further comprises a holder with a receiving region, wherein the holder is arranged in the housing so as to be tiltable about an axis parallel to the roller axis. The holder and accordingly the blade can thus be removed from the roller surface by tilting, for example if no milling operation is carried out, in order to protect the blade and the roller surface.

According to the invention, an elastic bearing is arranged between the blade and the receiving region.

The elastic bearing in the receiving region of the blade ensures that the blade is not fixedly clamped in the holder, but a movement of the blade relative to the holder is allowed. In particular, when contacting the roller surface, the blade is bent and hugs the roller surface such that a camber, and a bending, or thermal expansion, occurring during operation of the roller, can be compensated for. It will be understood that the elastic bearing is arranged on that side of the blade which, during operation of the roller mill, when the blade contacts the roller surface, is pressure-loaded, that is to say faces away from the roller. The blade can thus be configured in such a way that bending thereof to adapt to the roller surface is possible, but, for other bending moments, in particular bending moments parallel to the roller axis, is flexurally rigid such that flutter of the blade during operation is avoided. The holder is preferably arranged on the roller mill in such a way that, during a moment of the roller axis (for example a skewing movement), the axis of the holder remains parallel to the roller axis.

The receiving region preferably has the form of a groove, wherein an elastic bearing is arranged at least between a groove wall and the blade.

The thickness of the bearing (on one or both sides of the blade) is typically between 2 and 10 mm within the scope of the invention.

The groove wall for the purposes of the present invention refers to the wall of the groove that extends in the depth direction of the groove. The groove bottom for the purposes of the present invention refers to the wall of the groove that is directed away from an open side of the groove that corresponds with a lateral surface of the holder.

Here, the groove is preferably formed as a groove with two mutually parallel groove walls and a planar groove bottom which is arranged perpendicularly to the groove walls.

An elastic bearing is preferably arranged between the blade and both groove walls.

Such an embodiment allows bending of the blade on both sides such that, in order to allow the same freedom of movement as the above-described embodiment with only one elastic bearing, two elastic bearings which are half as thick have to be arranged on both sides of the blade.

The blade preferably abuts on a groove bottom.

This ensures that slipping of the blade as a result of the contact pressure of the blade against the roller surface is avoided since, by contrast with scrapers according to the prior art, the blade is not rigidly connected to the holder.

The blade and the at least one elastic bearing are preferably held in a clamping profile which is arranged in the receiving region.

In order to facilitate mounting, there can be provision that the blade and the at least one elastic bearing are held in a clamping profile. The clamping profile is then plugged into the receiving region and held there by retaining means.

In a corresponding manner to the above-described embodiments relating to the configuration of the blade and of the at least one elastic bearing in the groove, the clamping profile can be configured in such a way that an elastic bearing is arranged on one profile wall (which corresponds to a groove wall) or on both profile walls. The blade can likewise abut on a profile bottom (corresponds to the groove bottom) in order to avoid slipping.

The blade and/or the holder and/or the clamping profile preferably comprise/comprises lateral limiting means which prevent a displacement of the blade in the axial direction with respect to the roller axis.

The blade preferably takes the form of a flat profile, in particular with a rectangular cross section.

The blade is preferably formed from a cold-rolled steel strip (for example of steel grade WB, without chromium and nickel, hardened, tempered and white polished). Particular preference is given to blades having a tensile strength in the range from 1550-2350 MPa (measured in accordance with EN 10132-1).

The thickness of the blade is typically 0.5 to 2 mm within the scope of the invention.

The blade preferably has a ratio of length to width of 1.6:1 to 300:1.

The blade length for the purposes of the present application means the spatial extent of the blade in the direction of extent of the scraper edge. The length of the blade can be between 100 mm and 3000 mm, preferably between 500 mm and 2500 mm, particularly preferably between 1000 mm and 2000 mm, for example 1500 mm.

The blade width for the purposes of the present application means the spatial extent perpendicular to the blade length. The width of the blade can be between 10 mm and 60 mm, preferably between 20 mm and 55 mm, particularly preferably 30 mm and 50 mm, for example 40 mm.

The blade height for the purposes of the present application therefore means the spatial extent of the blade perpendicular to the blade length and to the blade width that extends from the scraper edge to an end directed away from the scraper edge. Within the scope of the invention, between 10 and 30 mm of the total blade height is typically received in the elastomer bearing.

The blade preferably has a ratio of the height to the free height of 6:1, preferably of more than 1:1 to 6:1.

The free height of the blade for the purposes of the present application means the height dimension of the blade that projects out of the holder. Since the blade does not contact the holder, the free height is therefore understood to mean the height dimension between the scraper edge and an (imaginary) envelope surface of the holder.

The blade is preferably arranged at an angle between 20° and 75°, preferably between 30° and 60°, particularly preferably between 30° and 50°, to the roller surface when the blade contacts the roller surface.

The angle is measured as the angle between a plane tangential to the roller surface and the height direction of extent of the blade.

Since the roller is cambered, the blade when contacting the roller is bent according to the invention and therefore the angle over the length of the blade slightly varies, the reference angle used is the angle in the center of the roller where the camber of the roller is at its maximum.

The elastic bearing can be formed of elastomer materials or comprise such materials, preferably selected from the group consisting of: natural rubber (NR); styrene-butadiene rubber (SBR); butyl rubber (IIR); ethylene-propylene rubber (EPDM); nitrile rubber (NBR); chloroprene neoprene (CR); chlorosulfonated polyethylene, Hypalon (CSM); polyurethane rubber (AU, EU); silicone rubber ((M)Q); polyacrylate elastomer (ACM); hydrogenated nitrile rubber (H-NBR); fluorene rubber, Viton (FPM); polyurethane (PE). Particular preference is given to ethylene-propylene rubber (EPDM) and silicone rubber ((M)Q).

In the simplest case, the elastic bearing is formed as an elastomer strip. The bearing, in particular the elastomer strip, can be formed in a continuous or else interrupted manner over the entire blade length. An interrupted formation of the bearing is possible and expedient in particular for individual adaptation of the stiffness of the resulting overall bearing; thus, for example, a harder material can be arranged in an interrupted manner in order to achieve a hardness over the overall bearing that corresponds to a continuous bearing made of a softer material.

The bearing, in particular the elastomer material of the elastomer strip, has a hardness between 15 and 100 Shore 00, preferably between 30 and 90 Shore 00, particularly preferably between 40 and 80 Shore 00 (in accordance with ASTM D 2240; and/or between 5 and 30 Shore A (measured in accordance with DIN ISO 7619-1).

The density of the elastic bearing can be between 0.25 $g/cm^3$ and 0.85 $g/cm^3$, preferably 0.35 $g/cm^3$ and 0.75 $g/cm^3$, particularly preferably 0.45 $g/cm^3$ and 0.65 $g/cm^3$ (in accordance with DIN 53479 A).

Such an embodiment represents a very simple and cost-effective variant. In addition, depending on the application, the strip can be exchanged and its hardness can be adapted.

The holder is preferably provided with a counterweight by means of which the blade can be tilted about the axis and can be pressed against the roller surface.

This makes it possible in a simple manner to set the contact pressure of the blade against the roller, whether by changing the weight and/or the lever arm length.

The scraper is preferably in operative connection with a lift-off device by means of which the blade can be tilted about the axis and can be moved away from the roller surface.

This embodiment allows the removal of the blade from the roller surface when no milling operation takes place and is in particular coupled to an actuator arrangement of the rollers such that, when the rollers are moved in and/or out, the blade is likewise brought into contact with the blade surface and/or moved away therefrom.

The blade is preferably arranged in such a way that the scraper edge is parallel to the roller axis when the blade does not contact the roller surface.

The blade is preferably received over its entire length in the receiving region. The elastic bearing is therefore formed over the entire length of the blade.

Alternatively, the blade can be received in the receiving region only in certain portions and/or the elastic bearing can be formed over the length of the blade only in certain portions. It will be understood that in such a case, in the regions without elastic bearing, the blade, when it does not contact the roller surface, must likewise not contact the receiving region.

The invention will be better described below on the basis of preferred exemplary embodiments in conjunction with the figures, in which.

Figure 1:
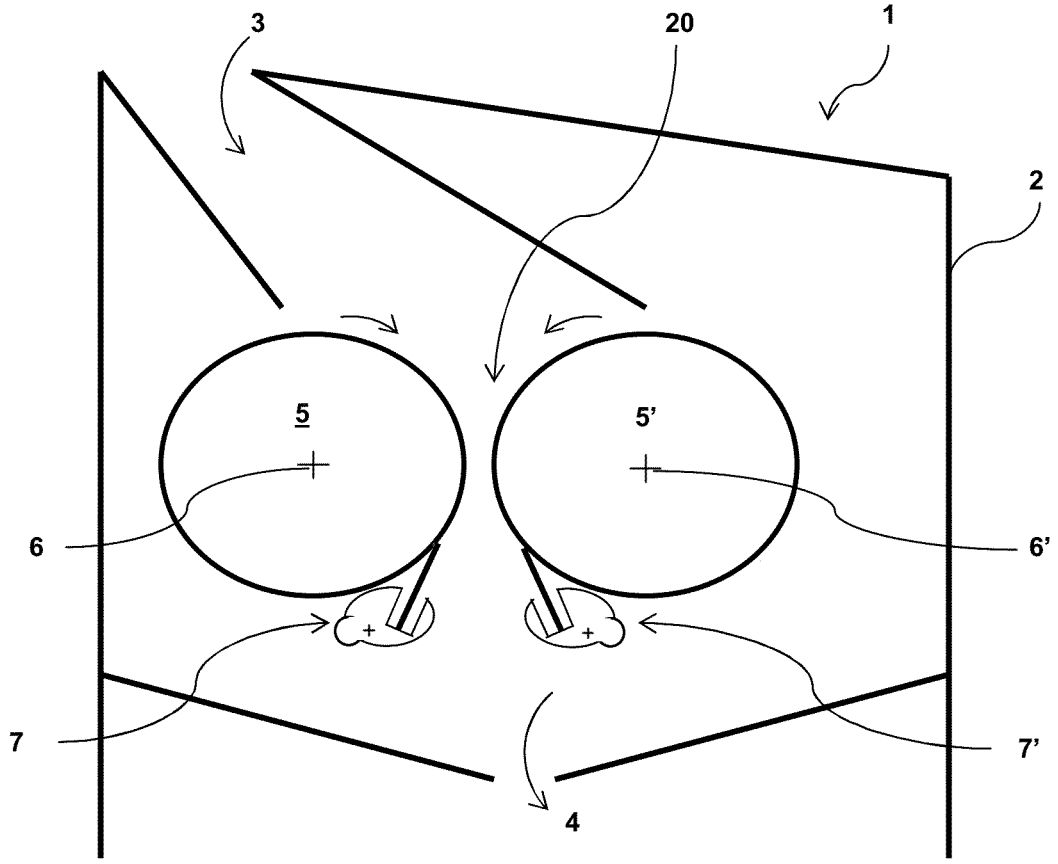
FIG. 1 shows a schematic sectional view of the roller mill according to the invention.

FIG. 1 schematically shows a roller mill 1 according to the present invention. The roller mill 1 comprises a housing 2 having a milling-material inlet, indicated by the arrow 3, and a milling-material outlet 4, also indicated by the arrow 4. In the housing 2 there are arranged two cambered rollers 5 and 5' which are each mounted so as to be rotatable about a roller axis 6 or 6' and can be driven in opposite directions by means of a drive (not illustrated). The direction of rotation of the rollers 5 and 5' is indicated by a respective arrow.

Directly downstream of a milling gap 20, each roller 5 or 5' is assigned a scraper 7 or 7'. The scraper 7 of the roller 5 is shown separately in two possible variants in FIGS. 2 and 3.

Figure 2:
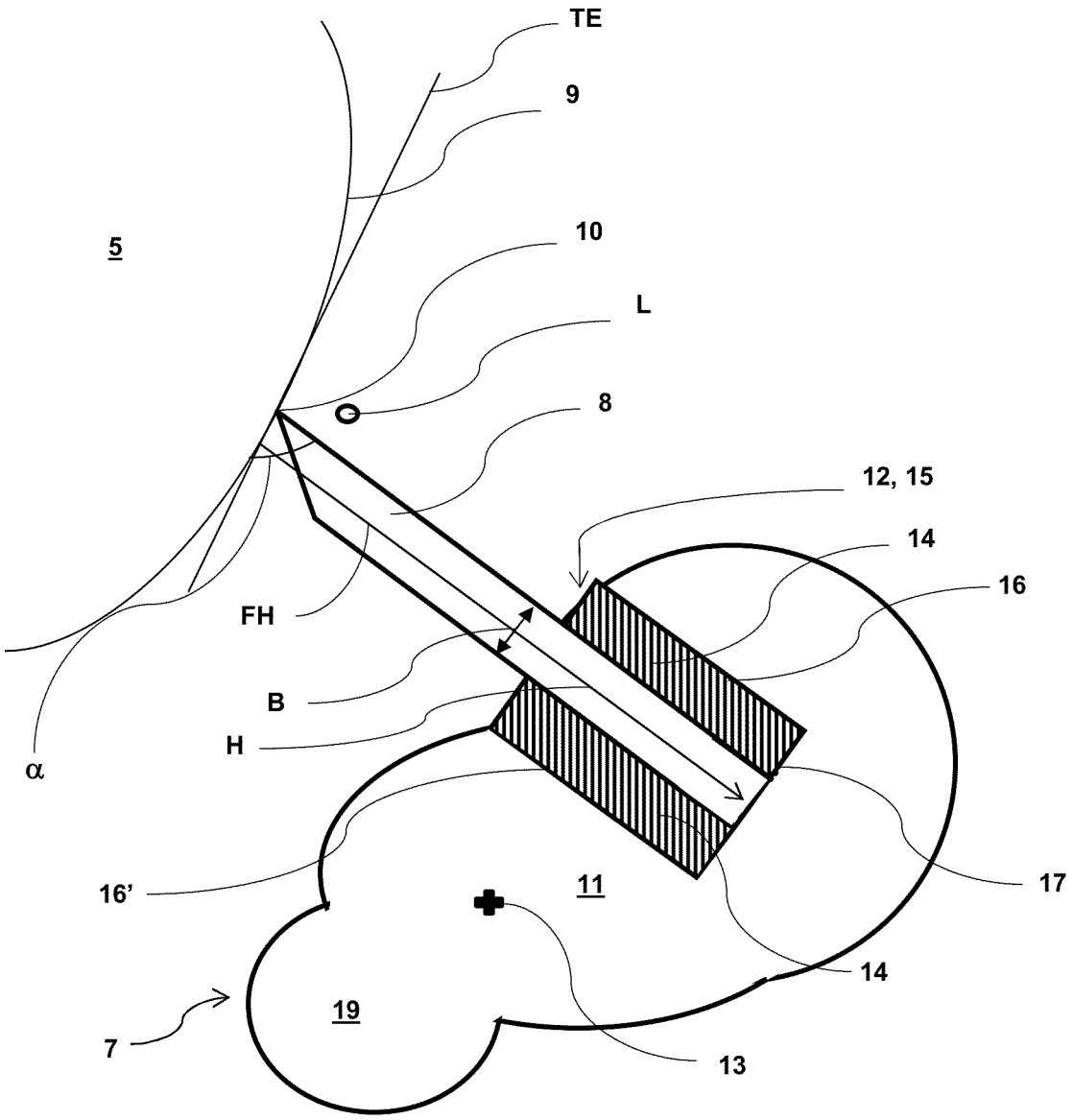
FIG. 2 shows a schematic sectional view of the scraper according to a first preferred embodiment of the invention.
Figure 3:
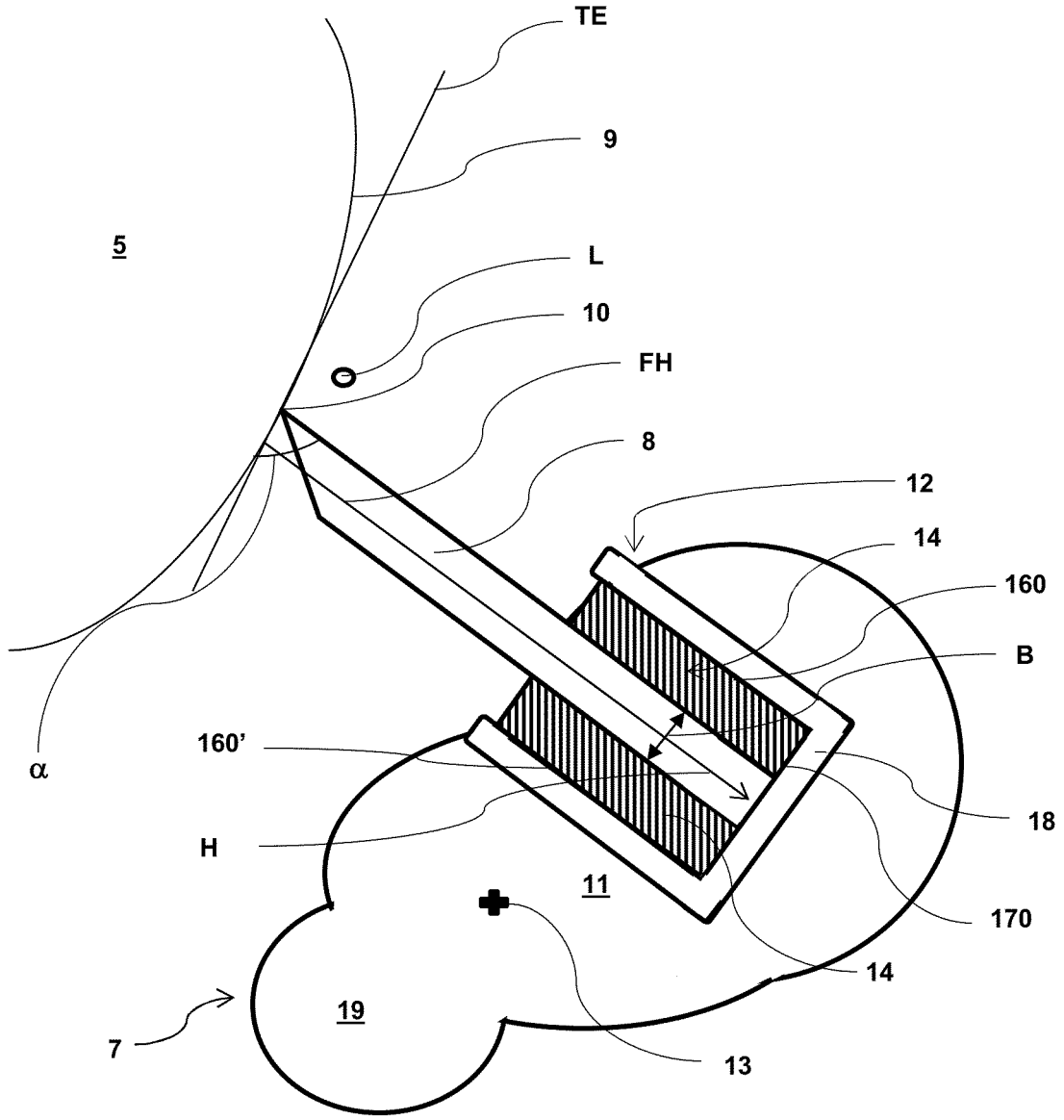
FIG. 3 shows a schematic sectional view of the scraper according to a second preferred embodiment of the invention.

The scraper 7 of FIGS. 2 and 3 comprises a blade 8 which is formed from a flat metal profile having a length L, a width B and a height H. The longitudinal direction of the blade 8 is indicated by the vector L.

In FIGS. 2 and 3, the blade 8 contacts a roller surface by way of a scraper edge 10 which is of pointed configuration. The blade 8 is arranged so as to be inclined at an angle $\alpha$ between a plane TE, which is tangential to the roller surface 9 at the contact point of the blade 8, and the blade 8.

In the embodiment of FIGS. 2 and 3, the scraper 7 has a holder 11 which is arranged so as to be tiltable about an axis 13. The axis 13 runs parallel to the roller axis 6 or 6' and remains parallel to the roller axis 6 or 6' even when the roller axis is displaced, for example during a skewing of the rollers.

In the embodiment of FIG. 2, the holder 11 comprises a receiving region 12 which is provided as a groove 15 having two groove walls 16 and 16' which run parallel to one another and having a groove bottom 17 running perpendicularly thereto, which extend in the longitudinal direction L of the blade 8 (and thus of the holder 11). The blade 8 is arranged in the groove 15 and contacts the groove bottom 17 by the end directed away from the scraper edge. An elastomer strip 14 is arranged on both sides of the blade 8 between the respective groove wall 16 or 16' and the blade 8, with the result that the blade 8 enjoys a certain freedom of movement in the groove 15 and in particular can be bent by a bending moment parallel to the height of the blade 8 and can adapt to the camber of the roller 5.

FH denotes the free height of the blade 8 that corresponds to the height of the blade 8 that is not arranged between the elastomer strips 14.

In order that the blade 8 can be pressed against the roller surface 9, the holder 11, as already explained above, is arranged so as to be tiltable about the axis 13. Moreover, the holder comprises a counterweight 19 which, by lever effect, causes the holder 11 to be tilted and the blade 8 to be pressed against the roller surface 9.

The scraper 7 illustrated in FIG. 3 corresponds in terms of design substantially to the scraper 7 of FIG. 2 with the difference that the blade 8 and the elastomer strips 14 are arranged in a clamping profile 18, wherein the clamping profile 18 is plugged into the receiving region 12 of the holder 11.

The clamping profile 18 takes the form of a plastics profile and has two profile walls 160 and 160' which run parallel to one another and a profile bottom 170 running perpendicularly thereto, which correspond in their function to the groove walls 16 or 16' and the groove bottom 17.

The clamping profile 18 simplifies the placement of the blade 8 with the elastomer strips 14 into the receiving region 12.

The invention claimed is:

1. A roller mill (1) comprising:

a housing (2) having a milling-material inlet (3), at least one milling-material outlet (4), and at least two cambered rollers (5, 5') which are each arranged in the housing (2) so as to be rotatable about a roller axis (6), wherein at least one roller (5) is assigned a scraper (7), and the scraper (7):

has a blade (8) for scraping milling material from a roller surface (9) with a scraper edge (10) which extends over an entire length (L) of the blade (8), and comprises a holder (11) with a receiving region (12), the holder is arranged in the housing (2) so as to be tiltable about an axis (13) parallel to the roller axis, an elastic bearing (14) is arranged between the blade (8) and the receiving region (12), and wherein the receiving region (12) has the form of a groove (15), and the elastic bearing (14) is arranged at least between a groove wall (16) and the blade (8);

wherein the blade (8) is arranged in such a way that the scraper edge (10) is parallel to the roller axis (6) when the blade (8) does not contact the roller surface.

2. The roller mill (1) as claimed in claim 1, wherein the elastic bearing (14) is arranged between the blade (8) and both groove walls (16, 16').

3. The roller mill (1) as claimed in claim 1, wherein the blade (8) abuts on a groove bottom (17).

4. The roller mill (1) as claimed in claim 1, wherein the blade (8) and the elastic bearing (14) are held in a clamping profile (18) which is arranged in the receiving region (12).

5. The roller mill as claimed in claim 1, wherein the blade (8) has a ratio between a length (L) and width (B) of 1.6:1 to 300:1.

6. The roller mill (1) as claimed in claim 1, wherein the blade (8) has a ratio between the height (H) and the free height (FH) of more than 1:1 to 6:1.

7. The roller mill (1) as claimed in claim 1, wherein the blade (8) is arranged at an angle (a) of between 200 and 75° to the roller surface (9).

8. The roller mill (1) as claimed in claim 1, wherein the elastic bearing (14) is formed as an elastomer strip with a Shore 00 hardness of between 15 and 100.

9. The roller mill (1) as claimed in claim 1, wherein the holder is provided with a counterweight (19) by means of which the blade (8) can be tilted about the axis (13) and can be pressed against the roller surface (9).

10. The roller mill (1) as claimed in claim 1, wherein the scraper (7) is in operative connection with a lift-off device by means of which the blade (8) can be tilted about the axis (13) and can be moved away from the roller surface (9).

11. The roller mill (1) as claimed in claim 1, wherein the blade (8) is received over its entire length (L) in the receiving region (12).

12. The roller mill (1) as claimed in claim 1, wherein the blade (8) is arranged at an angle (a) of between 30° and 60° to the roller surface (9).

13. The roller mill (1) as claimed in claim 1, wherein the elastic bearing (14) is formed as an elastomer strip with a Shore 00 hardness of between 30 and 90.

14. The roller mill (1) as claimed in claim 1, wherein the blade (8) is arranged at an angle (a) of between 30° and 50° to the roller surface (9).

15. The roller mill (1) as claimed in claim 1, wherein the elastic bearing (14) is formed as an elastomer strip with a Shore 00 hardness of between 40 and 80.

* * * * *